US009021924B2

(12) United States Patent
Hsieh

(10) Patent No.: US 9,021,924 B2
(45) Date of Patent: May 5, 2015

(54) WRENCH

(71) Applicant: Kabo Tool Company, Taichung (TW)

(72) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 264 days.

(21) Appl. No.: 13/716,198

(22) Filed: Dec. 16, 2012

(65) Prior Publication Data

US 2013/0269490 A1 Oct. 17, 2013

(30) Foreign Application Priority Data

Apr. 13, 2012 (TW) ..... 101113281 A

(51) Int. Cl.
*B25B 23/00* (2006.01)
*B25B 13/04* (2006.01)
*B25B 13/08* (2006.01)

(52) U.S. Cl.
CPC ..... *B25B 23/0007* (2013.01); *B25B 13/04* (2013.01); *B25B 13/08* (2013.01)

(58) Field of Classification Search
CPC ..... B25B 13/04; B25B 13/06; B25B 13/08; B25B 23/0007; B25B 23/0071
USPC ..... 81/119, 121.1, 124.3, 124.4, 125.1; D8/28, 29
See application file for complete search history.

(56) References Cited

U.S. PATENT DOCUMENTS

| | | | | | |
|---|---|---|---|---|---|
| 1,261,565 | A | * | 4/1918 | Leitner | 81/125.1 |
| 2,332,602 | A | * | 10/1943 | Rosenbloom | 81/125.1 |
| D177,636 | S | * | 5/1956 | Meier et al. | D8/28 |
| D278,510 | S | * | 4/1985 | Schoeberlein | D8/28 |
| D484,375 | S | * | 12/2003 | Hsieh | D8/28 |
| D484,760 | S | * | 1/2004 | Hsieh | D8/28 |
| 2010/0275739 | A1 | * | 11/2010 | Hart | 81/124.4 |

* cited by examiner

*Primary Examiner* — Hadi Shakeri
(74) *Attorney, Agent, or Firm* — CKC & Partners Co., Ltd.

(57) ABSTRACT

A wrench includes a handle, a first driver, and a second driver. The first driver and the second driver are integrally connected to two ends of the handle respectively. An angle between a driving axis of the first driver and a central axis of the handle is α, an angle between one opening end of the first driver and the handle is ϕ, an angle between a driving axis of the second driver and the central axis of the handle is β, and an angle between one opening end of the second driver and the handle is θ. The angle α and the angle β are located at two sides of the central axis of the handle respectively. The other opening end of the first driver and the other opening end of the second driver are horizontally connected to the handle respectively.

4 Claims, 4 Drawing Sheets

WRENCH

RELATED APPLICATIONS

The application claims priority to Taiwan Application Serial Number 10113281, filed Apr. 13, 2012, which is herein incorporated by reference.

BACKGROUND

1. Field of Invention

The present disclosure relates to a hand tool. More particularly, the to present disclosure relates to a wrench.

2. Description of Related Art

A conventional wrench has a main body and two drive portions extending horizontally from two ends of the main body respectively. When the conventional wrench is operated for applying to a workpiece assembled at a device with an uneven surface, it is hard to operate the workpiece rigidly by the conventional wrench, or the operating angle or the applicable range of the conventional wrench would be confined. Furthermore, the user is unable to hold the conventional wrench comfortably and is likely to be injured due to the improper holding gesture during the operation.

SUMMARY

According to one aspect of the present disclosure, a wrench includes a handle, a first driver, and a second driver. The first driver is integrally connected to an end of the handle and the second driver is integrally connected to the other end of the handle. An angle between a driving axis of the first driver and a central axis of the handle is $\alpha$ and an angle between one opening end of the first driver and the handle is $\phi$. An angle between a driving axis of the second driver and the central axis of the handle is $\beta$ and an angle between one opening end of the second driver and the handle is $\theta$. The angle $\alpha$ and the angle $\beta$ are located at two sides of the central axis of the handle respectively. The other opening end of the first driver is horizontally connected to the handle. The other opening end of the second driver is horizontally connected to the handle. The second driver is hollow tube-shaped and has a plurality of teeth.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
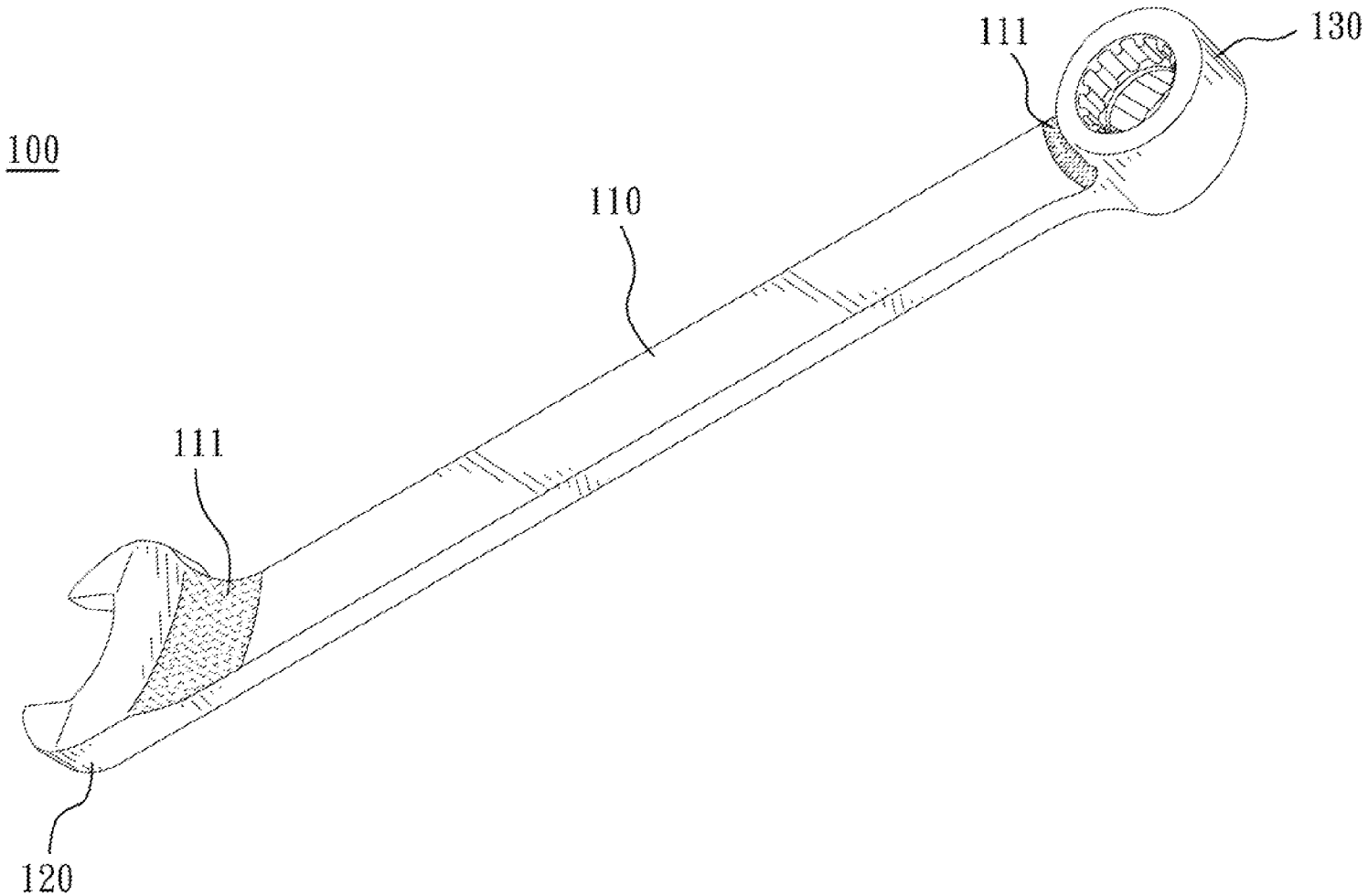
FIG. 1 is a three dimensional view of a wrench according to one embodiment of the present disclosure.

FIG. 1 is a three dimensional view of a wrench according to one embodiment of the present disclosure. In FIG. 1, the wrench 100 includes a handle 110, a first driver 120, and a second driver 130. The first driver 120 and the second driver 130 are integrally connected to two ends of the handle 110 respectively. The two ends of the handle 110 have an embossed portion 111 disposed that prevents hand slipped. Be noted that the embossed portion 111 may only disposed at one of the two ends of the handle 110.

Figure 2:
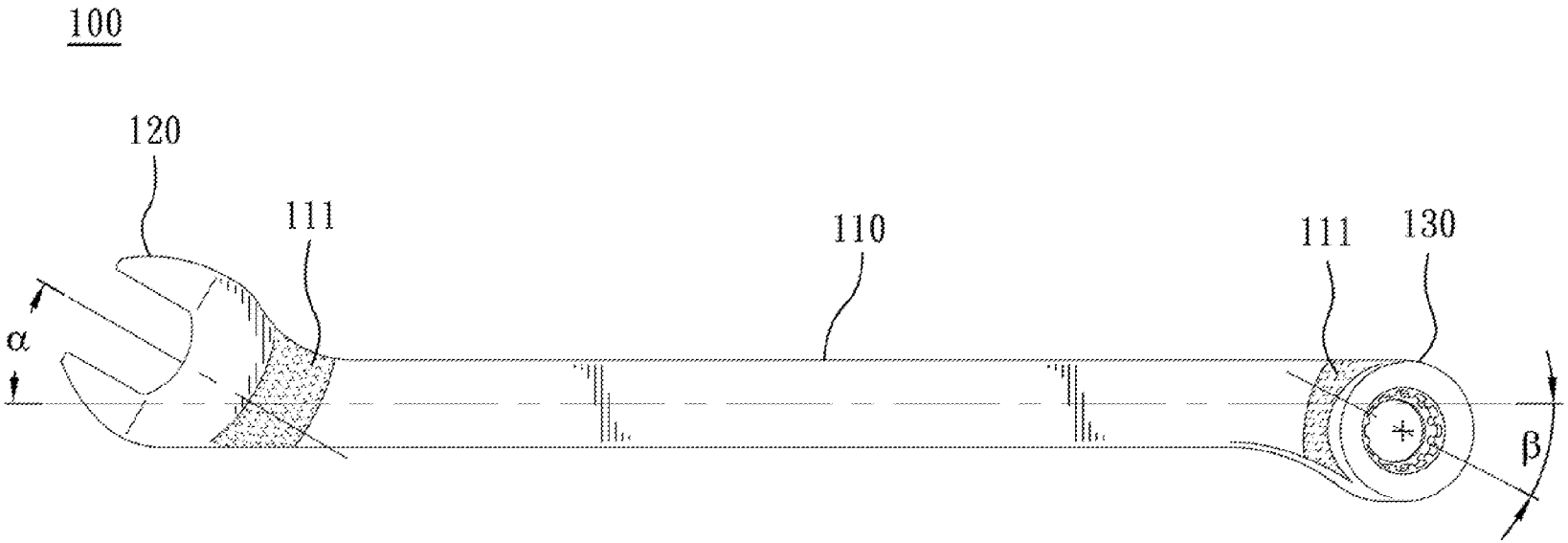
FIG. 2 is a front view of the wrench of FIG. 1.

FIG. 2 is a front view of the wrench of FIG. 1. In FIG. 2, an angle $\alpha$ is formed between a driving axis of the first driver 120 and a central axis of the handle 110, wherein 7 degrees$<\alpha<$45 degrees. An angle $\beta$ is formed between a driving axis of the second driver 130 and the central axis of the handle 110, wherein 7 degrees$<\beta<$45 degrees. Specifically, the angle $\alpha$ and the angle $\beta$ are located at two sides of the central axis of the handle 110 respectively. Both the driving axis of the first driver 120 and the driving axis of the second driver 130 deviate from the central axis of the handle 110, wherein the angle $\alpha$ and the angle $\beta$ are on the two sides of the central axis of the handle 110 respectively, thereby enabling the operation of the wrench 100 to be labor-saving and the holding of the wrench 100 to be convenient and comfortable.

Figure 3:
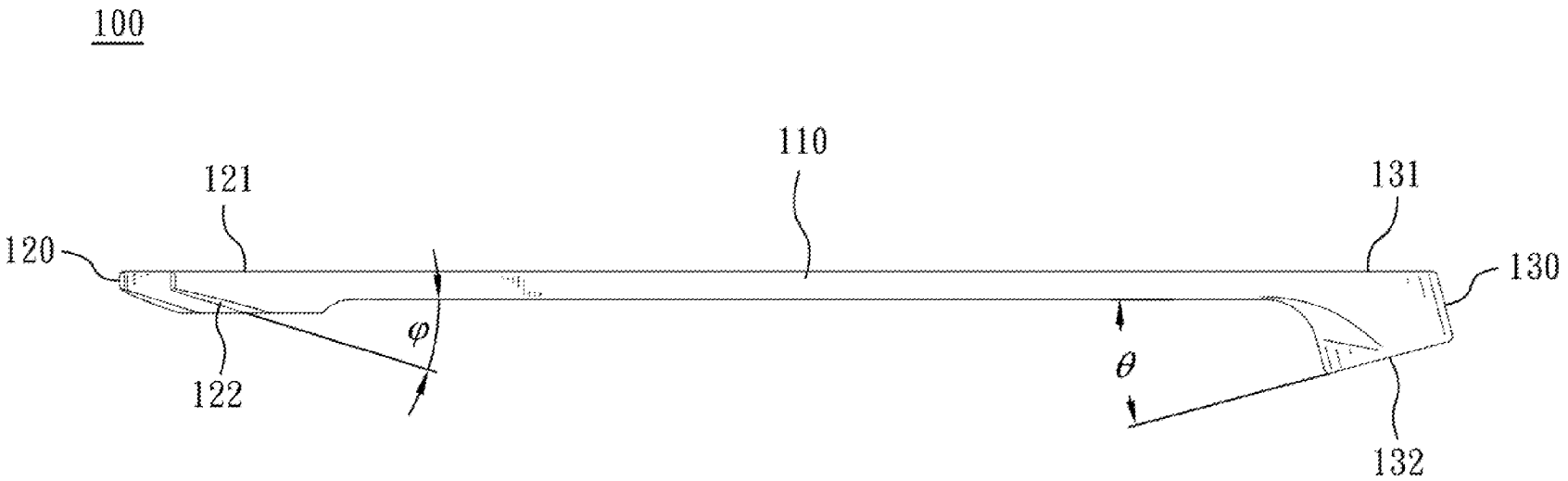
FIG. 3 is a side view of the wrench of FIG. 1.

FIG. 3 is a side view of the wrench of FIG. 1. In FIG. 3, an angle $\phi$ is formed between one opening end 122 of the first driver 120 and the handle 110, wherein 0 degrees$<\phi<$25 degrees. An angle $\theta$ is formed between one opening, end 132 of the second driver 130 and the handle 110, wherein 0 degrees$<\theta<$25 degrees. Thus, the wrench 100 can be adapted to a workpiece assembled at a device with an uneven surface or located adjacent to an obstruction of a device. The angle $\phi$ and the angle $\theta$ also make the wrench 100 easy to hold and the user can change the holding manner as needed during operation. On the other hand, the other opening end 121 of the first driver 120 and the other opening end 131 of the second driver 130 are horizontally connected to the handle 110 respectively. Thus, the wrench 100 can fit a flat edge of a device and both the first driver 120 and the second driver 130 can rigidly contact a workpiece on the device that make the operation of the wrench 100 smoother.

Figure 4:
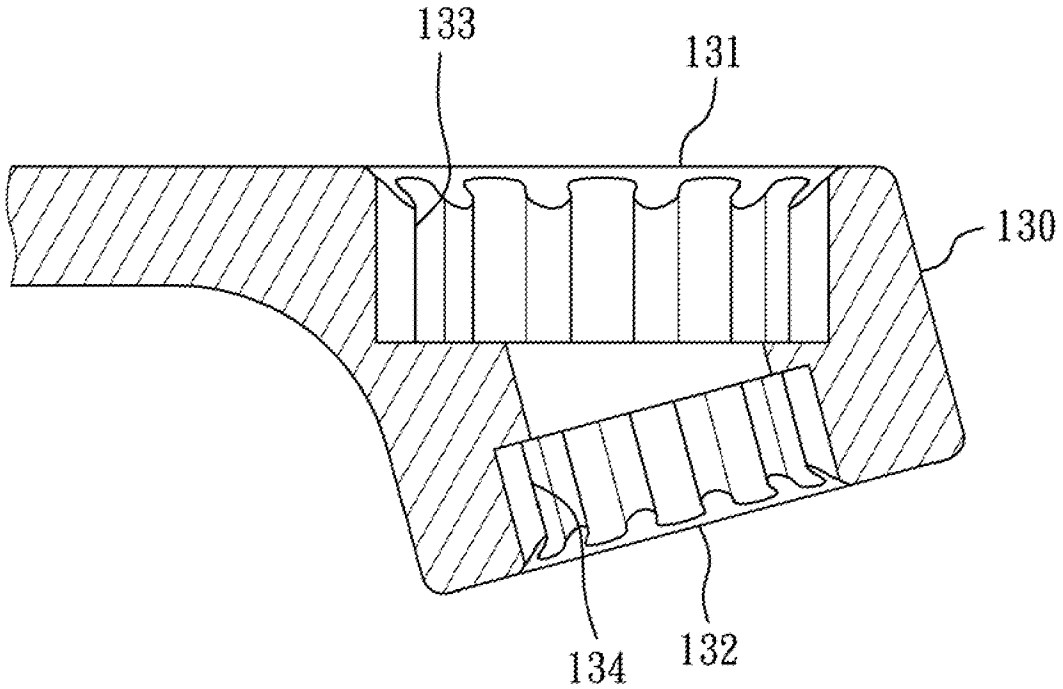
FIG. 4 is a partial sectional view of the wrench of FIG. 1.

FIG. 4 is a partial sectional view of the wrench of FIG. 1. In FIG. 4, the second driver 130 is hallo tube-shaped and has a plurality of teeth. The teeth include a first teeth portion 133 and a second teeth portion 134. The first teeth portion 133 is perpendicular to the opening end 131 of the second driver 130, and the second teeth portion 134 is perpendicular to the opening end 132 of the second driver 130.

As described above, the present disclosure has the following advantages:

1. The angles facilitate the holding of the wrench 100 and make the operation of the wrench 100 labor-saving.

2. The opening end 121 of the first driver 120 and the opening end 131 of the second driver 130 are horizontally connected to the handle 110 respectively that make the operation of the wrench 100 smoother.

3. The embossed portion 111 disposed at the handle 110 prevents hand slipped.

Although the present disclosure has been described in considerable detail with reference to certain embodiment thereof, other embodiments are possible, Therefore, their spirit and scope of the appended claims should no be limited to the description of the embodiment container herein.

It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims.

What is claimed is:

1. A wrench comprising:

a handle having two ends, a central longitudinal axis, and two opposing first and second surfaces;

a first driver integrally connected to one of the ends of the handle, the first driver having a driving axis and opposing opening ends, wherein an angle $\alpha$ between the driving axis of the first driver and the central longitudinal axis of the handle is greater than 7 degrees and less than 45 degrees, an angle $\phi$ between one of the opening ends of the first driver and the second surface of the handle is greater than 0 degrees and less than 25 degrees, and the other of the opening ends of the first driver and the first surface of the handle are substantially aligned horizontally; and a second driver integrally connected to the other one of the ends of the handle, the second driver having a driving axis and opposing first and second opening ends, wherein an angle $\beta$ between the driving axis of the second driver and the central longitudinal axis of the handle is greater than 7 degrees and less than 45 degrees, the first opening end of the second driver and the first surface of the handle are substantially aligned horizontally, and an angle $\theta$ between the second opening end of the second driver and the second surface of the handle is greater than 0 degrees and less than 25 degrees;

wherein the second driver is a hollow, tube-shaped, box-end type of wrench driver, and comprises:

a first teeth portion that extends inwardly from the first opening end of the second driver and that has teeth that are substantially perpendicular to the first opening end of the second driver; and a second teeth portion that extends inwardly from the second opening end of the second driver and that has teeth that are substantially perpendicular to the second opening end of the second driver;

wherein the first teeth portion of the second driver is physically separated from the second teeth portion, and angled differently from the second teeth portion;

wherein a part of the first teeth portion where the first teeth portion first extends inwardly from the first opening is flush with the handle;

wherein an embossed portion is formed on the handle at a juncture between the handle and the first driver, and another embossed portion is formed on the handle at a junction between the handle and the second driver;

wherein each of the embossed portions is indented.

2. The wrench of claim 1, wherein the handle has a uniform thickness throughout a length thereof.

3. The wrench of claim 1, wherein the angle $\alpha$ between the driving axis of the first driver and the central longitudinal axis of the handle and the angle $\beta$ between the driving axis of the second driver and the central longitudinal axis of the handle are located respectively on two opposite sides of the central longitudinal axis of the handle.

4. The wrench of claim 1, wherein the first driver is a U-shaped, open-end type of wrench driver.

* * * * *